US007721847B2

(12) United States Patent
Coury

(10) Patent No.: US 7,721,847 B2
(45) Date of Patent: May 25, 2010

(54) ACOUSTIC PANEL

(75) Inventor: Charles C. Coury, Coburg, OR (US)

(73) Assignee: 9 Wood, Inc., Springfield, OR (US)

( * ) Notice: Subject to any disclaimer, the term of this patent is extended or adjusted under 35 U.S.C. 154(b) by 0 days.

(21) Appl. No.: 12/028,731

(22) Filed: Feb. 8, 2008

(65) Prior Publication Data

US 2008/0289901 A1 Nov. 27, 2008

Related U.S. Application Data

(60) Provisional application No. 60/920,239, filed on Mar. 27, 2007.

(51) Int. Cl.

| | |
|---|---|
| ***E04B 1/82*** | (2006.01) |
| ***E04B 1/84*** | (2006.01) |
| ***E04B 1/99*** | (2006.01) |
| *E04B 1/62* | (2006.01) |
| *E04B 1/74* | (2006.01) |
| *E04B 1/86* | (2006.01) |

(52) U.S. Cl. ..... 181/293; 52/144

(58) Field of Classification Search ..... 181/293, 181/285, 295, 210, 284, 30, 290, 292, 296; 52/144, 145

See application file for complete search history.

(56) References Cited

U.S. PATENT DOCUMENTS

| | | | | |
|---|---|---|---|---|
| 1,554,179 | A | 9/1925 | Trader | |
| 1,804,884 | A * | 5/1931 | Mazer | 181/293 |
| 1,825,770 | A | 10/1931 | Barnett | |
| 1,913,249 | A * | 6/1933 | Sersen | 52/145 |
| 2,007,130 | A * | 7/1935 | Munroe et al. | 181/285 |
| 2,165,101 | A | 7/1939 | Hudson | |
| 2,271,871 | A * | 2/1942 | Newport et al. | 52/145 |
| 2,280,631 | A | 4/1942 | Coffey | |
| 2,292,444 | A * | 8/1942 | Haydon et al. | 52/599 |
| 2,459,121 | A * | 1/1949 | Willey et al. | 181/293 |
| 3,103,255 | A | 9/1963 | Boschi et al. | |
| 3,269,484 | A | 8/1966 | Lighter | |
| 3,287,869 | A | 11/1966 | Kilgore | |
| 3,656,576 | A * | 4/1972 | Gubela | 181/210 |
| 3,846,949 | A * | 11/1974 | Okawa | 52/438 |
| 3,991,848 | A | 11/1976 | Davis | |
| 4,146,113 | A * | 3/1979 | Gavel | 181/210 |

(Continued)

FOREIGN PATENT DOCUMENTS

| | | |
|---|---|---|
| GB | 001398330 | 6/1975 |

*Primary Examiner*—Edgardo San Martin
(74) *Attorney, Agent, or Firm*—Kolisch Hartwell, P.C.

(57) ABSTRACT

An acoustic panel is provided with a plurality of grooves in a front face and at least one well in a back face. The well is defined by a first end wall and an opposing second end wall and opposing side walls extending between the end walls. The grooves and the well intersect and have a sufficient combined depth to form a plurality of holes through the panel. The grooves may extend substantially from one end edge to the opposing end edge. The well may be substantially elongate and extend from a position adjacent to, and spaced from one side edge of the panel to a position adjacent to, and spaced from the opposite side edge of the panel. The well may include a substantially flat bottom and receive an acoustic fill material that may be held in place by compression and friction.

38 Claims, 6 Drawing Sheets

U.S. PATENT DOCUMENTS 4,226,299 A * 10/1980 Hansen ..... 181/284
4,420,526 A * 12/1983 Schilling et al. ..... 428/171
4,566,558 A 1/1986 Link, Jr. et al.
4,842,097 A 6/1989 Woodward et al.
4,860,506 A * 8/1989 Yoshimi et al. ..... 52/144
4,971,850 A * 11/1990 Kuan-Hong ..... 428/137
5,024,290 A 6/1991 Birker
5,268,540 A * 12/1993 Rex ..... 181/210
5,362,931 A 11/1994 Fries
5,422,446 A 6/1995 Fries
5,744,763 A * 4/1998 Iwasa et al. ..... 181/286
5,854,453 A 12/1998 Fujiwara et al.
6,035,965 A 3/2000 Fujiwara et al.
6,209,680 B1 * 4/2001 Perdue ..... 181/295
7,322,441 B2 * 1/2008 D'Antonio et al. ..... 181/293
2002/0175023 A1 * 11/2002 Wilson ..... 181/293
2003/0006092 A1 * 1/2003 D'Antonio et al. ..... 181/293
2004/0065506 A1 * 4/2004 Salls ..... 181/285
2009/0038883 A1 * 2/2009 Kim ..... 181/291

* cited by examiner

ACOUSTIC PANEL

BACKGROUND

Panels are typically installed over the ceilings and walls of rooms to provide an aesthetically pleasing appearance. Panel materials for such a finished appearance, e.g., wood or metal, do not typically improve room acoustics because the materials are substantially non-sound-absorbing. Such panels have been made more acoustically transparent or sound absorbing by providing holes through the panels, e.g., by providing edge-to-edge grooves on both faces of the panel, thus creating holes at the intersections of the grooves. Another method has been to bore holes through the panels or to bore holes on one face and provide edge-to-edge grooves on the opposite face. When such panels are installed, the back face of the panel is covered edge-to-edge by an expanse of an acoustically absorptive material.

SUMMARY

An acoustic panel according to the present disclosure may include a plurality of grooves in the front face and one or more wells formed in the back face. The well typically is defined by a first end wall and an opposing second end wall and opposing side walls extending between the end walls. The well extends across several of the grooves, creating holes through the board at areas of intersection with the plural grooves. The well typically has a flat bottom and substantially vertical walls to receive and hold a piece of acoustic fill material, such as fiberglass, cotton absorptive material, knitted absorptive cord, or non-woven acoustic scrim.

Generally, the grooves extend substantially from one edge to an opposing edge of the panel. The well typically does not extend all the way to an edge of the panel, but rather the end walls of the well are adjacent to, but spaced from, the edges of the panel. The well may be substantially elongate and may extend substantially perpendicularly with respect to the grooves in the front face. The acoustic fill material may be fitted to be compressed between the walls of the well. Mounting hardware may be positioned on the side edges of the panel for attaching the panel to a wall or ceiling mount. The mounting hardware and wells may be placed so that the wells do not detract from the structural strength of the panel adjacent the mounting hardware.

The acoustic panel may be produced by cutting the grooves in the front face with a saw, e.g., with a circular saw blade forming the grooves as the kerfs of the cutting. Elongate wells may be produced by cutting with a router, typically in a direction substantially perpendicular to the grooves. Then, an acoustic fill material may be inserted in the well to be held there by frictional force between the fill material and the walls of the well and/or expansive forces if the fill material has been compressed as part of the inserting.

DETAILED DESCRIPTION

Figure 1:
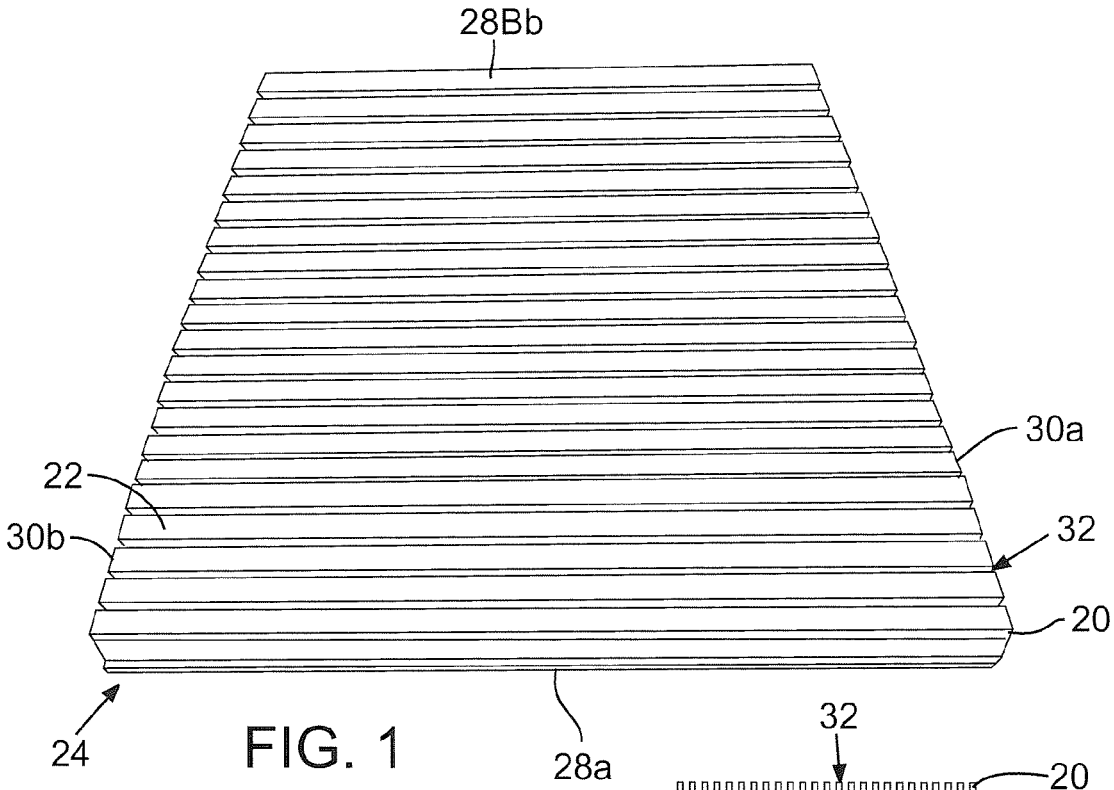
FIG. 1 is a perspective view of a panel according to an embodiment of the present disclosure, showing a finished front face with a plurality of parallel grooves, each groove extending from an end edge to an opposite end edge of the panel, the plural grooves spaced apart at regular intervals across the panel from adjacent one side edge to adjacent an opposite side edge.
Figure 2:
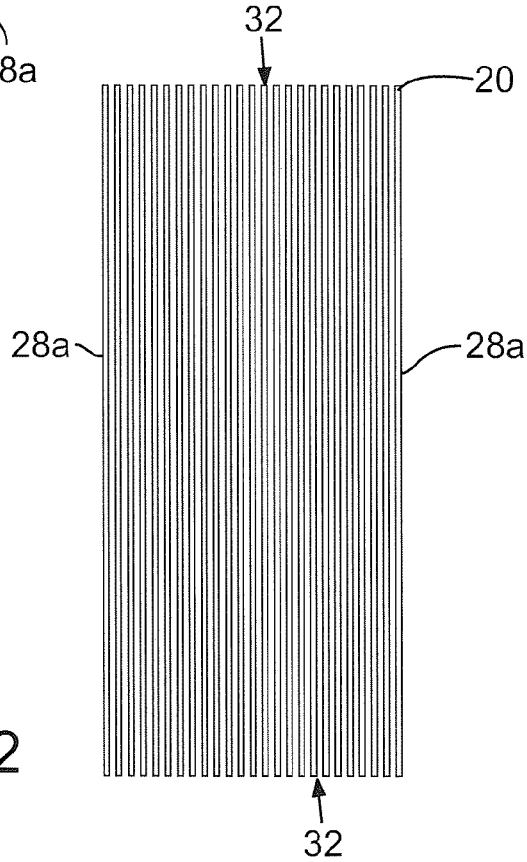
FIG. 2 is a schematic plan view of the panel of FIG. 1, showing the front face and grooves.
Figure 7:
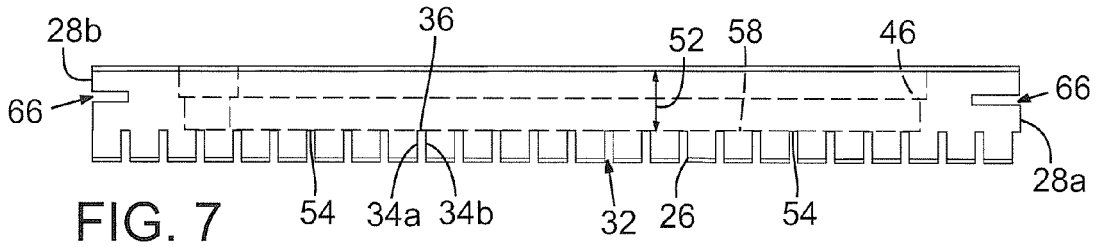
FIG. 7 is a schematic view of an alternative embodiment of the present disclosure, showing a stepped wall for the well.
Figure 8:
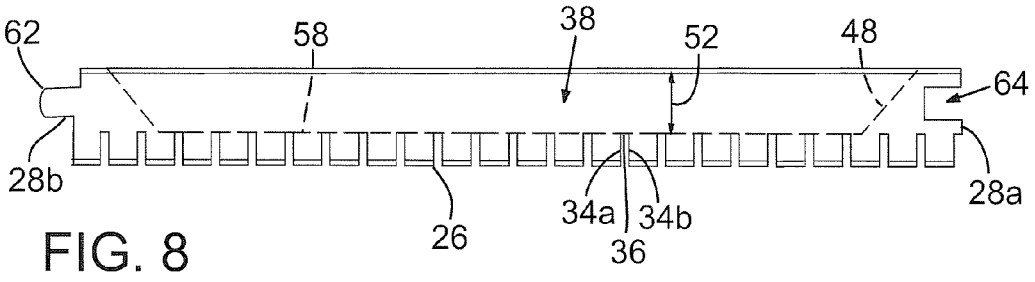
FIG. 8 is a schematic view of an alternative embodiment of the present disclosure, showing a slanted wall for the well.

As shown in FIGS. 1 and 2, an acoustic panel 20 may be formed of wood or other material suitable for a particular application. Panel 20 is shown as having a rectangular or square layout, but may be formed in any desired shape. Panel 20 includes a front face 22 and an opposite back face 24 (best seen in FIGS. 3 and 4). Front face 22 may be provided with a finished appearance, e.g., by application of a wood veneer 26 (FIGS. 7 and 8). Panel 20 includes two opposing side edges 28*a*, 28*b*, and two opposing end edges 30*a*, 30*b*. Panel 20 may be any size as appropriate for an installation, e.g., about 96 inches along the side edges and about 2 inches to about 8 inches wide (along the end edges), and ¾ inches thick.

Panel 20 includes one or more grooves 32 in front face 22. For example, panel 20 is shown with twenty-four grooves, each extending from end edge 30*a* to end edge 30*b*. As best seen in FIGS. 1 and 5-8, grooves 32 typically are substantially parallel to one another and to the side edges and begin at the end edge and extend all the way through to the opposing end edge. Grooves 32 may be formed with a rectangular cross-section with two flat, straight, vertical side walls 34*a*, 34*b*, and flat bottom 36.

Grooves 32 may be provided with any dimension and cross-section as may be selected for desired acoustical properties in view of materials used for the various components of the panel, mounting considerations, and other variables.

Typically, grooves 32 are provided with a uniform size, shape, and spacing, but these may be varied as deemed suitable for various applications. For example, substantially all of the grooves may be about 2 mm (or about 1/16 inch) wide, about 5 to about 10 mm deep, and spaced apart at about 8 mm (or about 5/16 inch) on-center.

Back face 24 of panel 20 may be provided with at least one well 38 defined by a first end wall 40*a* and an opposing second end wall 40*b*. Well 28 is further defined by opposing side walls 42*a*, 42*b* extending between end walls 40*a*, 40*b*. Typically, end walls 40*a*, 40*b* are curved or semicircular in layout and side walls 42*a*, 42*b* are straight, and all walls are vertical, i.e., perpendicular to back face 24, but may be provided with any suitable shape. For example, as seen in FIGS. 7 and 8, well 38 may be provided with a stepped wall 46, or a slanted wall 48, or other acoustically vented shape, i.e., a shape that expands outwardly.

Figure 3:
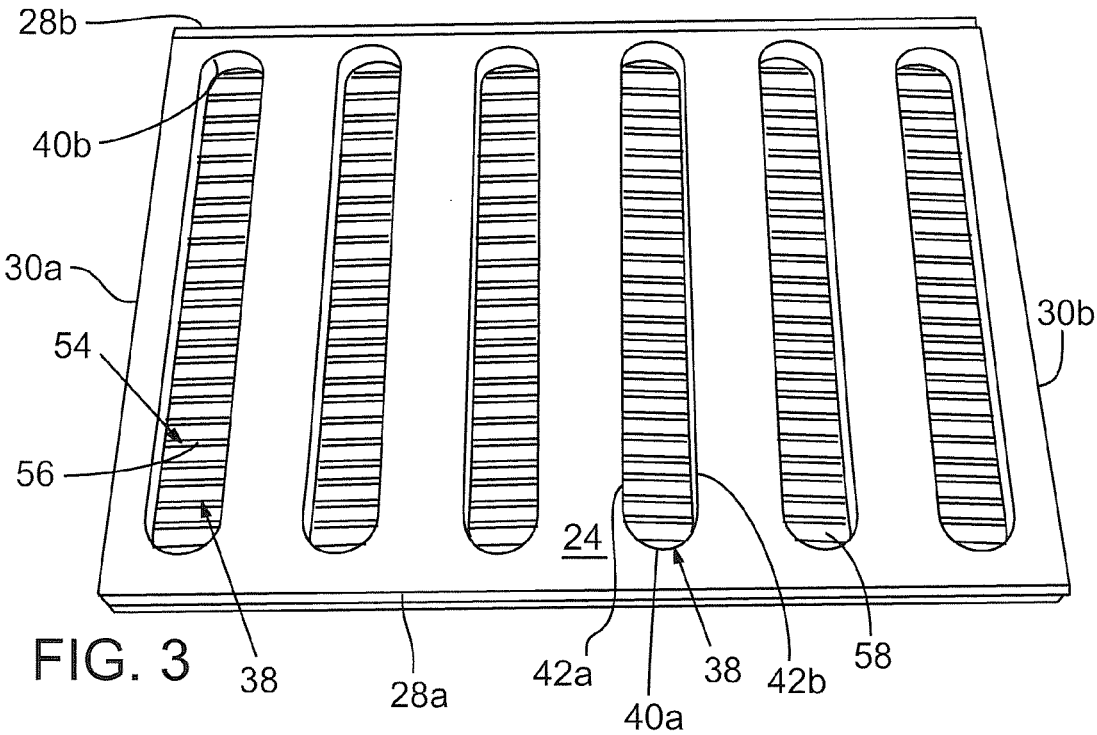
FIG. 3 is a perspective view of the panel of FIG. 1, showing the back face with a plurality of parallel, elongate, racetrack-shaped wells, each well having a flat bottom and vertical, curved end walls and vertical, straight side walls and extending from adjacent a side edge to adjacent an opposite side edge of the panel, the plural wells spaced apart at regular intervals along the panel from adjacent one end edge to adjacent an opposite end edge, and also showing the grooves at areas of intersections between the grooves and the wells where holes through the panel are formed.
Figure 4:
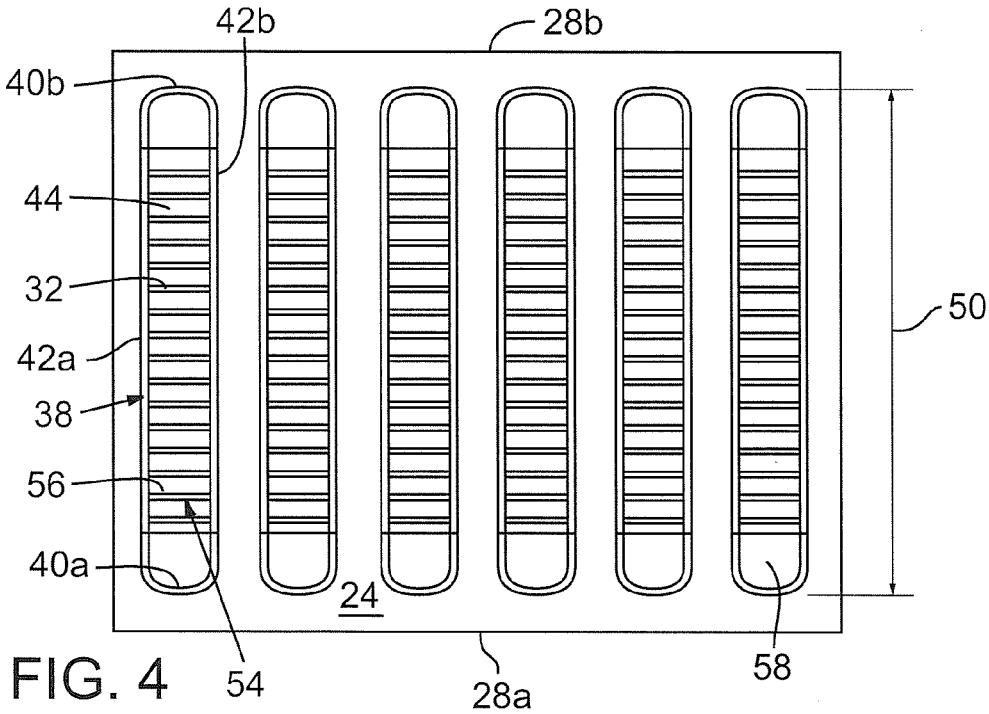
FIG. 4 is a schematic plan view of the panel of FIG. 1, showing the back face, wells, and through-holes.

Generally, well 38 has a dimension and cross-section selected for a desired acoustical property in coordination with the selection for the grooves. Well 38 may include a length 50 and a depth 52 sufficient to form a plurality of holes 54 through panel 20 at each of a plurality of areas of intersection 56 between well 38 and grooves 32. For example, as seen in FIG. 3, each well 38 includes about twenty-two areas of intersection 56 between the well and the grooves on the opposite side, each area of intersection providing a hole 54 through panel 20. Such holes typically are designed to allow sound waves to pass through panel 20, and may be shaped as desired for the acoustical properties for a particular application Well 38 may be provided with a substantially elongate shape, such as that shown in FIGS. 3 and 4. For example, for the 96 inch×8 inch panel above, well 38 may be about 6½ inches long (end wall 40*a* to end wall 40*b*) and about 1 inch wide (side wall 42*a* to side wall 42*b*). A plurality of wells 38 may be spaced along panel 20, e.g., at 2 inches on-center, and may be substantially parallel to one another and to end edges 30*a*, 30*b* and substantially perpendicular to grooves 32.

Alternatively, wells 38 may be laid out in any suitable shape and pattern. Typically, the shape allows for reconfiguration or re-spacing of the grooves on the front face without the need to change or re-position the well. For example, the elongate shape for the well allows grooves 32 to be positioned at any of a wide variety of spacings, e.g., 4 mm on-center, 8 mm on-center, 16 mm on-center, etc.

Typically end wall 40*a* of well 38 is adjacent one side edge 28*a* of panel 20 and end wall 40*b* of well 38 is adjacent side edge 28*b* of panel 20. For example, the end walls of the well may be spaced apart from the side edges of the panel by about 10 to about 20 mm, which may be varied in accordance with the materials used for the various components of the panel, mounting considerations, and other variables.

Figure 9:
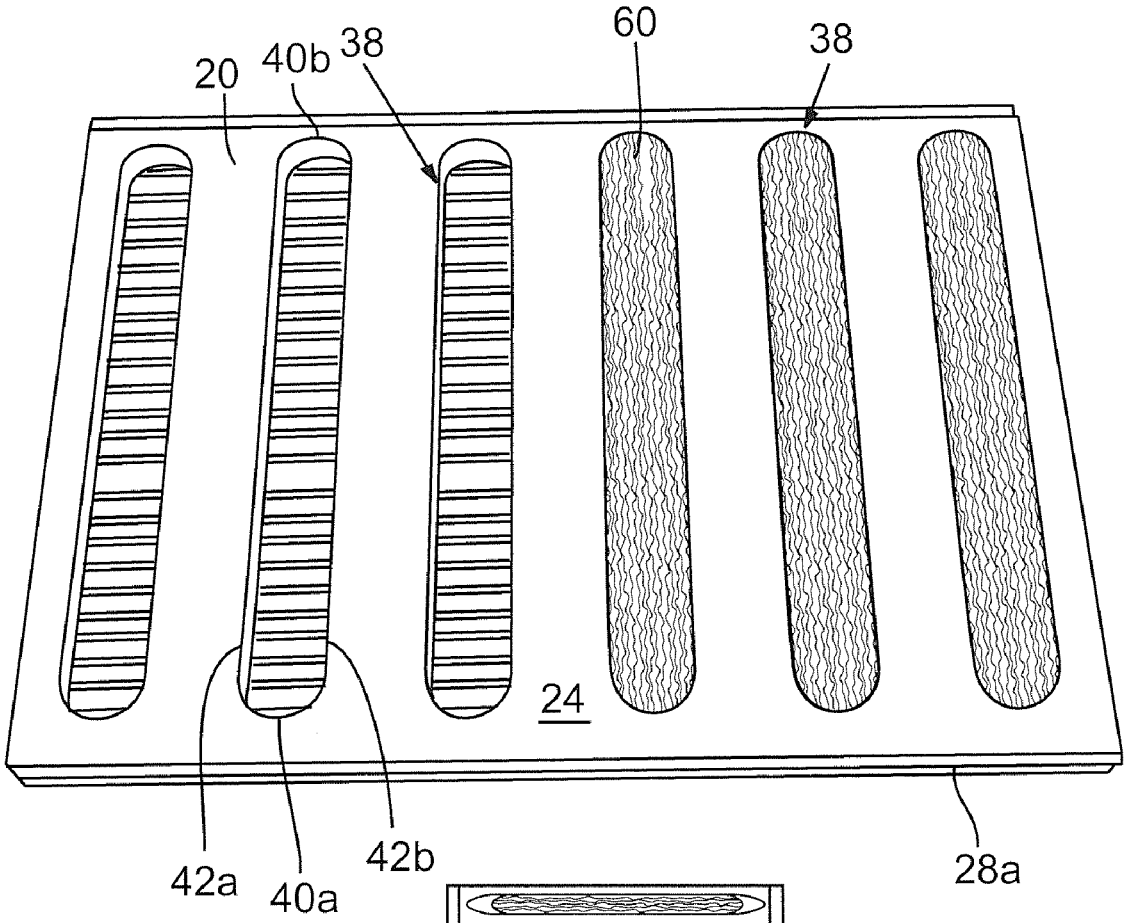
FIG. 9 is a perspective view of the panel of FIG. 1, showing the back face with an acoustic fill material inserted in three of the wells.
Figure 10:
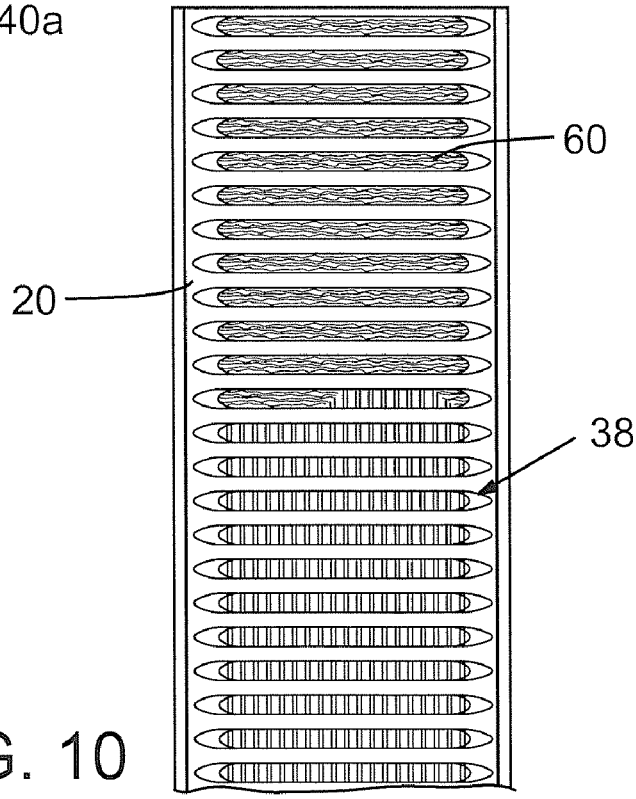
FIG. 10 is a schematic view of the panel of FIG. 1, showing the back face with an acoustic fill material shown as inserted in half of the wells.

Wells 38 may be provided with a substantially racetrack-type shape with curved end walls and substantially straight side walls, as described above, or with any suitable shape. Wells 38 are typically provided with a substantially flat bottom 58. Such shape and others are suitable for receiving and holding an acoustic fill material 60, as shown in FIGS. 9 and 10. Examples of acoustic fill material include fiberglass, cotton absorptive material, knitted absorptive cord, and non-woven acoustic scrim. Typically, the acoustic fill material will be sized and shaped so as to require that it be compressed, at least slightly, between the opposing walls of the well, which, along with friction, helps to hold the fill material in place in the well.

Figure 5:
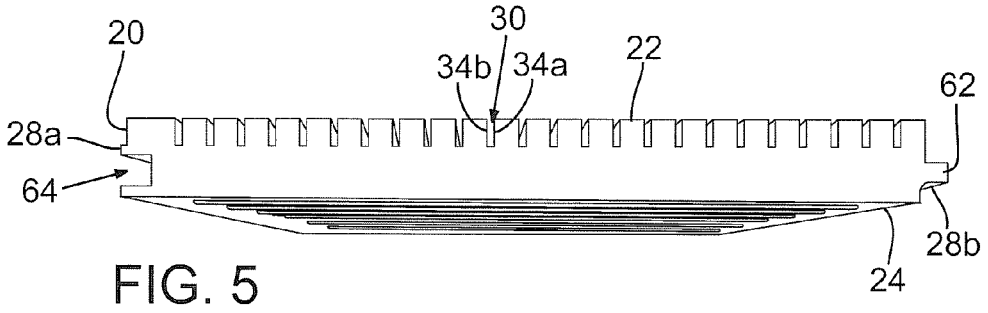
FIG. 5 is a perspective view of the end edge of the panel of FIG. 1, showing the cross-sectional shape of the grooves, and also a tongue and groove along the side edges of the panel, for mating between panels during installation.
Figure 6:
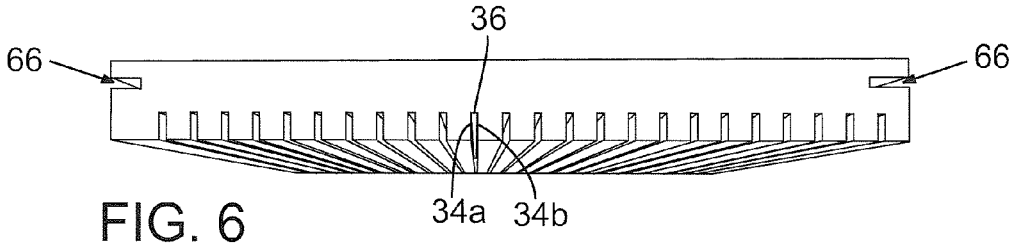
FIG. 6 is a perspective view of an alternative embodiment of the present disclosure, showing grooves along both side edges of the panel for mounting clips.

As shown in FIGS. 5 and 8, panels 20 may be provided with a tongue 62 along side edge 28*a* and a groove 64 along side edge 28*b* to help support and align the panels during installation. For example, tongue 62 of a first panel 20 would mate with groove 64 of a second panel 20 installed next to the first panel. Additionally, panels 20 may include grooves 66, as seen in FIGS. 6 and 7, for receiving mounting clips 68 (FIG. 13) and/or other mounting hardware. Such mounting hardware may be positioned on the side edges of the panel spaced apart from wells 38 so as to maintain structural integrity.

Panel 20 may be produced by cutting grooves 32 in the front face with a saw, e.g., a circular saw with ganged blades, or any suitable means. In the case of the circular saw, the grooves are formed as kerfs. Typically each groove is cut from one end edge to the opposing end edge and the grooves are spaced across the front face from adjacent one side edge to the opposing side edge.

Panel 20 may be provided with wells 38 by cutting the back face with a router, typically in a direction substantially perpendicular to the grooves. Generally, grooves 32 and wells 38 are cut to a sufficient combined depth to form plural holes 54 at plural areas of intersection 56 between the wells and the grooves.

Typically, the step of cutting the well begins adjacent one side edge of the panel and terminates adjacent the opposite side edge of the panel, with a sufficient space provided between the well and the side edges for desired structural strength. To form stepped wall 46 (FIG. 7), the step of cutting the well may include a first routing operation to cut the upper, wider portion of the well and a second routing operation to cut the lower, narrower portion of the well. Suitable machining using, a router or other cutting tool may be used to form slanted wall 48 (FIG. 8). Generally after cutting the well, acoustic fill material 60 may be inserted in the well, compressing the material as necessary to fit it within the walls of the well.

Figure 11:
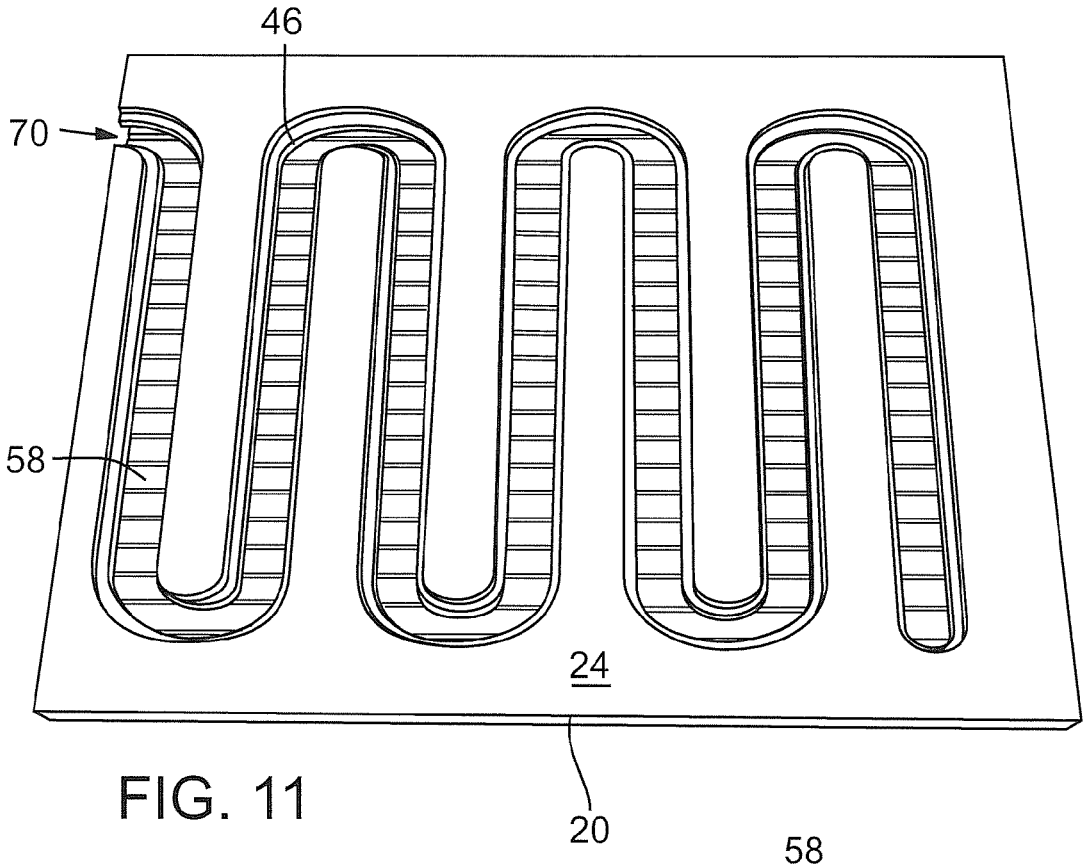
FIG. 11 is a perspective view of an alternative embodiment of the present disclosure, showing the back face with a serpentine, stepped-walled trough providing the holes at the areas of intersections with the grooves, the trough configured to receive an acoustic fill material.
Figure 12:
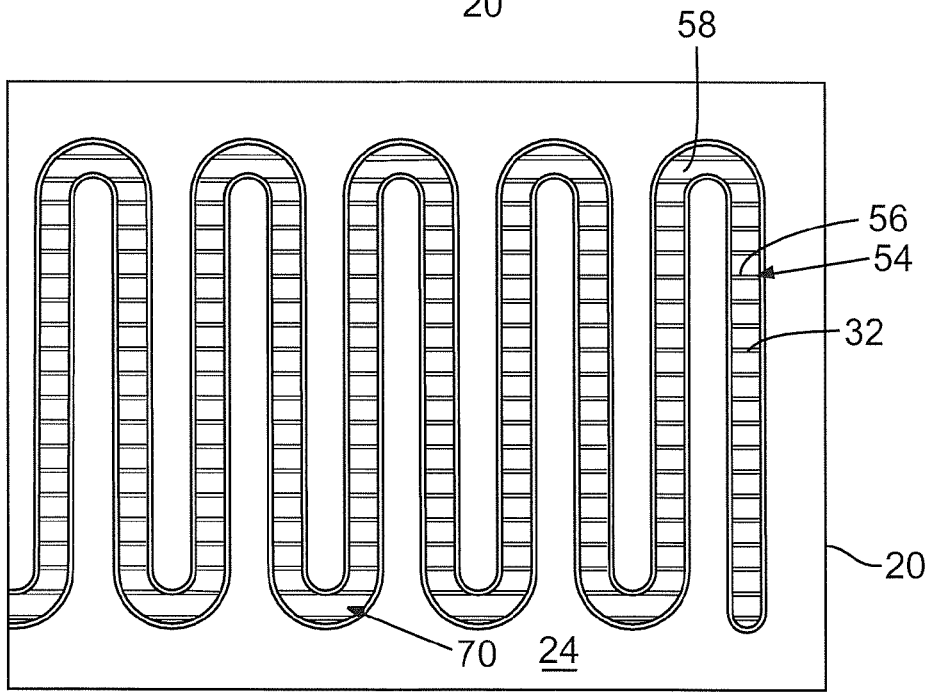
FIG. 12 is a schematic view of the panel of FIG. 11, showing the back face with the serpentine trough.

Alternatively, back face 24 may be provided with a trough 70 in a serpentine or other shape, as shown in FIGS. 11 and 12, which also can receive acoustic fill material 60.

Figure 13:
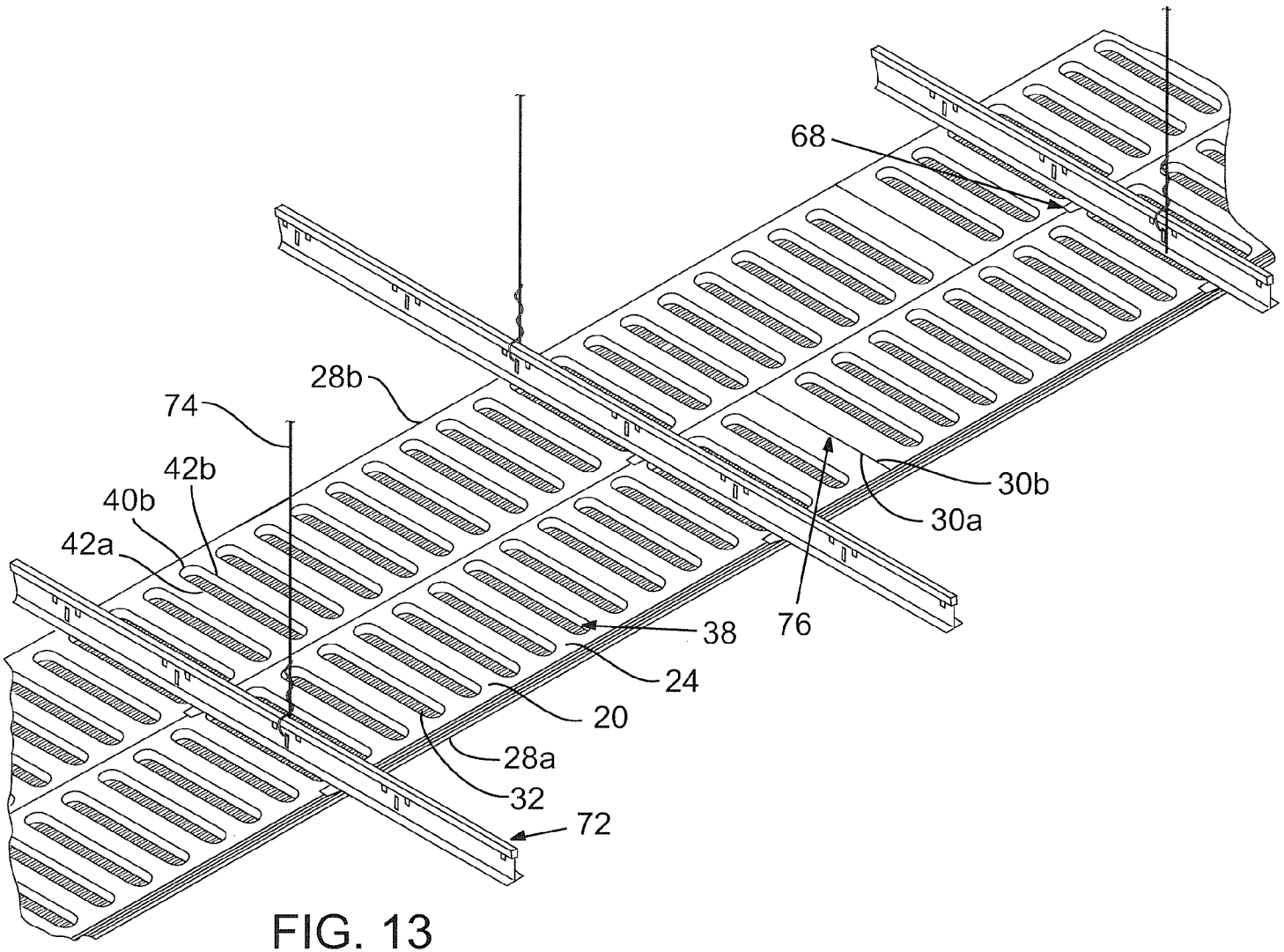
FIG. 13 is a schematic view of an installation of panels according to the present disclosure in a ceiling, showing T-bars held by hanging wire and clips coupling the panels to the T-bars.

A ceiling installation of panels 20 is shown in FIG. 13, where T-bars 72 are held by hanging wire 74 attached to the ceiling, and clips 68 couple the panels to the T-bars. Panels 20 are joined at side edges 28, e.g., by tongue-and-groove, and at end edges 30, e.g., with a 1/16 inch reveal 76.

The subject matter described herein includes all novel and non-obvious combinations and subcombinations of the various elements, features, functions and/or properties disclosed herein. Similarly, where the claims recite "a" or "a first" element or the equivalent thereof. such claims should be understood to include incorporation of one or more such elements, neither requiring nor excluding two or more such elements. It is believed that the following claims particularly point out certain combinations and subcombinations that are directed to one of the disclosed embodiments and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the present disclosure.

What is claimed is:

1. An acoustic panel defined by a front face and an opposite back face, two opposing side edges, and two opposing end edges, the acoustic panel comprising:

a plurality of grooves in the front face, wherein the grooves have a dimension and cross-section selected for an acoustical property; and at least one well in the back face, the well defined by a first end wall and an opposing second end wall and opposing side walls extending between the end walls, wherein the well has a dimension and cross-section selected for the acoustical property, including a length and a depth sufficient to form a plurality of holes through the panel at each of a plurality of areas of intersection with the plural grooves.

2. The acoustic panel of claim 1 wherein substantially all of the grooves are rectangular in cross-section.

3. The acoustic panel of claim 1 wherein substantially all of the grooves are about 2 mm wide.

4. The acoustic panel of claim 1 wherein substantially all of the grooves are about 5 mm deep.

5. The acoustic panel of claim 1 wherein substantially all of the grooves extend substantially from one end edge to the opposing end edge.

6. The acoustic panel of claim 1 wherein the plural grooves are spaced across the front face and include a groove adjacent one of the side edges and a groove adjacent the opposing side edge.

7. The acoustic panel of claim 1 wherein substantially all of the plural grooves are uniformly spaced at regular intervals across the front face.

8. The acoustic panel of claim 1 wherein substantially all of the grooves are spaced about 8 mm apart.

9. The acoustic panel of claim 1 wherein the well is substantially elongate and the first end wall is adjacent one side edge of the panel and the second wall is adjacent the opposite side edge of the panel.

10. The acoustic panel of claim 9 wherein at least one of the end walls of the well is spaced at least about 12 mm from the adjacent side edge of the panel.

11. The acoustic panel of claim 9 wherein the elongate well extends substantially perpendicularly with respect to the grooves in the front face.

12. The acoustic panel of claim 1 wherein the well extends across at least about ten areas of intersection with at least about ten of the front face grooves.

13. The acoustic panel of claim 1 further comprising plural elongate wells that are substantially parallel to one another.

14. The acoustic panel of claim 1 wherein the well has a substantially racetrack-type shape wherein the end walls are curved and the side walls are substantially straight.

15. The acoustic panel of claim 1 further wherein the well is defined by a substantially flat bottom.

16. The acoustic panel of claim 1 wherein at least one of the walls of the well is stepped.

17. The acoustic panel of claim 1 further comprising an acoustic fill material inserted in the well.

18. The acoustic panel of claim 17 wherein the acoustic fill material is compressed between at least two opposing walls of the well.

19. The acoustic panel of claim 1 wherein the grooves are substantially parallel to one another.

20. The acoustic panel of claim 1 wherein the side edges are substantially parallel to one another, and the grooves are substantially parallel to the side edges.

21. The acoustic panel of claim 1 wherein the grooves are kerfs.

22. The acoustic panel of claim 1 wherein the front face has a finished appearance.

23. The acoustic panel of claim 1 further comprising a tongue along one side edge and a mating groove along the opposing side edge.

24. The acoustic panel of claim 1 further comprising a tongue along one end edge and a mating groove along the opposing end edge.

25. An acoustic panel defined by a front face and an opposite back face, two opposing side edges, and two opposing end edges, the acoustic panel comprising:

a plurality of grooves in the front face, wherein the grooves have a dimension and cross-section selected for an acoustical property; and at least one well in the back face, the well defined by a first end wall and an opposing second end wall, two opposing side walls extending between the end walls, and a substantially flat bottom, wherein the well has a dimension and cross-section selected for the acoustical property, including a length and a depth sufficient to form a plurality of holes through the panel at each of a plurality of areas of intersection with the plural grooves.

26. An acoustic panel defined by a front face and an opposite back face, two opposing side edges, and two opposing end edges, the acoustic panel comprising:

a plurality of grooves in the front face, wherein the grooves have a dimension and cross-section selected for an acoustical property, and wherein each groove extends from one end edge to the opposing end edge;

a plurality of elongate wells in the back face, each well defined by a first end wall and an opposing second end wall, two opposing side walls extending between the end walls, and a substantially flat bottom, each well extending from adjacent one side edge to adjacent the opposing side edge, wherein each well has a dimension and cross-section selected for the acoustical property, including a length and a depth sufficient to form a plurality of holes through the panel at each of a plurality of areas of intersection with the plural grooves, the wells spaced apart along the back face; and mounting hardware positioned on the side edges for attaching the panel to a mount, wherein the mounting hardware is spaced apart from all of the wells.

27. A method for producing an acoustic panel, the method comprising:

providing a panel defined by a front face and an opposite back face, two opposing side edges, and two opposing end edges;

cutting a plurality of substantially parallel grooves in the front face with a saw, with each groove extending from one end edge to the opposing end edge, and the plurality of grooves spaced across the front face from adjacent one side edge to the opposing side edge;

cutting with a router, in a direction substantially perpendicular to the grooves, at least one elongate well in the back face, wherein the well extends across at least two of the grooves and wherein the grooves and well are cut to a sufficient depth to form plural holes at plural areas of intersection between the well and the grooves.

28. The method of claim 27 further including a step of cutting plural wells in the back face of the panel.

29. The method of claim 27 wherein the saw includes a circular saw blade.

30. The method of claim 27 wherein the saw includes ganged blades for cutting the plural grooves.

31. The method of claim 27 wherein the step of cutting the well begins adjacent one side edge of the panel and terminates adjacent the opposite side edge of the panel.

32. The method of claim 31 wherein the step of cutting the well begins at least about 12 mm from the adjacent side edge of the panel.

33. The method of claim 31 wherein the step of cutting the well terminates at least about 12 mm from the adjacent side edge of the panel.

34. The method of claim 27 wherein the step of cutting the well includes a first and a second routing operation to create a stepped wall for the well.

35. The method of claim 27 further comprising a step of inserting an acoustic fill material in the well.

36. The method of claim 35 wherein the step of inserting the acoustic fill material in the well includes compressing the material between at least two opposing walls of the well.

37. The method of claim 27 further including a step of providing the front face with a finished appearance.

38. The method of claim 27 further including a step of providing a tongue along one side edge and a mating groove along the opposing side edge of the panel.

* * * * *